United States Patent [19]

Greguoli

[11] Patent Number: 4,708,043

[45] Date of Patent: Nov. 24, 1987

[54] ADJUSTABLE CAM INDEXING FEED APPARATUS

[75] Inventor: Richard A. Greguoli, Meriden, Conn.

[73] Assignee: The Cly-Del Manufacturing Company, Waterbury, Conn.

[21] Appl. No.: 763,446

[22] Filed: Aug. 7, 1985

[51] Int. Cl.[4] ..... B26D 5/20

[52] U.S. Cl. ..... 83/219; 83/221; 74/568 R; 74/571 L; 226/19

[58] Field of Search ..... 74/568 R, 55, 571 L; 83/219, 220, 237, 221, 222; 226/16, 18, 19, 124

[56] References Cited

U.S. PATENT DOCUMENTS

| | | | |
|---|---|---|---|
| 242,100 | 5/1881 | Barnes | 74/571 |
| 432,594 | 7/1890 | Best | 74/571 |
| 618,173 | 1/1899 | Hassis | 74/571 |
| 654,020 | 7/1900 | Quist | 74/571 |
| 1,053,694 | 2/1913 | Anderson | 74/571 |
| 2,310,209 | 3/1942 | Bousman | 74/571 |
| 2,598,427 | 5/1952 | Place | 74/568 |
| 2,709,924 | 6/1955 | Castelli | 74/571 |
| 2,960,013 | 11/1960 | Novkov | 90/15 |
| 3,097,543 | 7/1968 | Godsil et al. | 74/568 |
| 3,129,662 | 4/1964 | Pearce | 83/36 |
| 3,248,978 | 5/1966 | Muller | 83/219 |
| 3,336,826 | 8/1967 | Sheffield | 83/219 |
| 3,635,102 | 1/1972 | Skeen | 74/600 |
| 3,662,635 | 5/1972 | Yabuta | 83/219 |
| 3,668,959 | 6/1972 | Richter et al. | 83/48 |
| 3,691,855 | 9/1972 | Cupler, II | 74/568 |
| 3,691,887 | 9/1972 | Roch | 83/219 |
| 3,695,133 | 10/1972 | Finko | 83/222 |
| 3,785,231 | 1/1974 | Lake, Jr. et al. | 83/103 |
| 3,880,034 | 4/1975 | Sapolsky | 83/220 |
| 3,988,937 | 11/1976 | Higuchi | 74/45 |
| 4,031,778 | 6/1977 | Fazekas | 74/571 L |
| 4,089,451 | 5/1978 | Zlaikha | 83/229 |
| 4,144,783 | 3/1979 | Yamazaki et al. | 83/219 |
| 4,364,281 | 12/1981 | Wunsch | 74/55 |
| 4,459,945 | 7/1984 | Chatfield | 74/55 |
| 4,506,574 | 3/1985 | Yamashita | 83/219 |

*Primary Examiner*—Frederick R. Schmidt
*Assistant Examiner*—Bradley I. Vaught
*Attorney, Agent, or Firm*—Lerner, David, Littenberg, Krumholz & Mentlik

[57] ABSTRACT

An apparatus for forwardly and laterally indexing a strip provided with an angular blanking pattern along a zigzag path is provided with an adjustable indexing cam mechanism. Forward and lateral indexing assemblies are provided as an integral unit whose operation is synchronized with that of a strip processing machine by means of a direct drive arrangement. The extent of lateral indexing is adjustable by altering the degree of eccentricity of a master cam plate provided within the indexing cam mechanism. The indexing cam mechanism provides the apparatus with dwell periods within which the strip is subjected to one or more operations, for example, blanking, with the dwell periods being independent of the degree of eccentricity of the master cam plate.

28 Claims, 3 Drawing Figures

ADJUSTABLE CAM INDEXING FEED APPARATUS

BACKGROUND OF THE INVENTION

The present invention relates in general to a strip-feeder assembly, and more particularly, to an adjustable cam indexing feed apparatus which integrally combines forward and lateral indexing of a continuous strip from a supply thereof in a zigzag manner and in ynchronization with the operation of a strip processing machine, such as a blanking or punching machine and the like, and which apparatus incorporates an adjustable cam mechanism to effect a predetermined amount of lateral indexing while providing intermittent dwell periods during which the strip processing machine performs its intended operation upon the zigzagging strip at staggered locations therealong.

In many industries, strip material provided in continuous strip form, such as metal and plastic strips, are cut into a number of pieces of various shapes by blanking or punch presses arranged at one or more strip processing stations. In the field of metal working, such working is called blanking, and the pieces cut out or blanked from the metal strips are called blanks. As a result of increasing material costs, there has been sought techniques to reduce material waste resulting from conventional single row in-line blanking. One such technique, which has been effective to decrease material waste and therefore stimulating savings through reduced material consumption, has been the use of a double row angular blanking pattern. The angular blanking pattern is arranged in such a manner, usually a thirty degree angle between blank centers, that a more effective use of material is achieved over the previously used single row in-line blanking. In order to economize on the use of an angular blanking pattern, it is required that the strip material be advanced through the blanking operation in a forward and lateral indexing manner to effect strip feeding along a zigzag path.

One known strip-feeder assembly which advances a strip along such a zigzag path, to accommodate an angular blanking pattern, employs forward and lateral strip indexing assemblies. Forward indexing is achieved by advancing the strip by means of a pair of nip rollers intermittently operated by means of a suitable drive assembly. On the other hand, lateral indexing is achieved by a rotating cam eccentrically mounted between a pair of spaced-apart cam followers which shuttle back and forth in unison upon alternate engagement with the rotating cam. This strip-feeder assembly, however, is economical primarily when dedicated to a single blanking operation employing strips having identical angular blanking patterns. When a strip having a different angular blanking pattern is employed, it becomes necessary that the strip feeder assembly be partially disassembled, so that the eccentrically mounted cam can be substituted for one having a different eccentricity in order to accommodate a different angular blanking pattern. This, of necessity, requires disruption of the strip processing operation, as well as the intended labor costs involved in partially dissassembling and re-assembling the strip-feeder assembly.

A known strip-feeder assembly which provides for adjustably controlling the amount of lateral indexing employs a cam driven slide which reciprocates a roll feed through a crank arm and tie rod arrangement, e.g., an adjustable linkage mechanism. A screw adjustment on the crank arm and tie rod provides control of the amount of lateral indexing of the roll feed to accommodate different angular blanking patterns, i.e., different blank diameters. The adjustable linkage mechanism is often unsatisfactory in that it will not maintain its accuracy over long periods of use, as well as being difficult to repair and service because of its complex arrangement and the large number of its component parts. Other arrangements of strip-feeding assemblies are known from U.S. Pat. Nos. 4,506,574, 3,880,034, 3,248,978, 1,053,694, 4,144,783, 3,336,826, 3,785,231 and 3,668,959. To the extent that these known assemblies have recognized the aforementioned problems and have devised other arrangements for providing adjustability for lateral indexing a strip, such other arrangements have generally employed hydraulic cylinders, rotatable screw drives and the like, which result in relatively complex and expensive arrangements, additional problems or expense in synchronizing with the strip processing operations, inability to maintain accuracy, and increased maintenance of the assemblies along with its attendant increased costs.

Accordingly, it can be appreciated that there is an unsolved need for an adjustable cam indexing feed apparatus which is operative for directly influencing or controlling the amount of lateral indexing, i.e., lateral offsetting movement, without the employment of adjustable linkage systems, and which utilizes a minimum number of components, which is of a relatively simple design, which maintains its accuracy during use, and which is easily maintained for providing the desired motions and control.

SUMMARY OF THE INVENTION

It is broadly an object of the present invention to provide an adjustable cam indexing feed apparatus which overcomes or avoids one or more of the foregoing disadvantages resulting from the use of the aforementioned strip feeder assemblies, and which meets the specific requirements of such an adjustable cam indexing feed apparatus for use in conjunction with a strip processing machine, for example, a blanking or punching machine and the like.

Specifically, it is within the contemplation of one aspect of the present invention to provide an adjustable cam indexing feed apparatus which is a totally self-contained, and fully adjustable mechanical unit that, when attached to a strip processing machine, for example, a press, will operate positively with each press cycle, in proper timed sequence with other machine functions, and having all the required feeding and indexing motions integrally combined.

Another object of the present invention is to provide an adjustable cam indexing feed apparatus which contains fewer component parts resulting in a compact assembly which is easy to maintain, set up and adjust.

Another object of the present invention is to provide an adjustable cam indexing feed apparatus which provides direct tie-in with strip processing machine to provide accurate synchronization of the forward and lateral indexing motions with the strip processing operations.

Another object of the present invention is to provide an adjustable cam indexing feed apparatus which integrally combines forward and lateral indexing motions operative with strip processing machines having right and left side strip feeds.

Another object of the present invention is to provide an adjustable cam indexing feed apparatus which is adapted for use in both single and multiple plunger presses of varying size and capacity.

Another object of the present invention is to provide an adjustable cam indexing feed apparatus which can run larger strip coils with less down time.

Another object of the present invention is to provide an adjustable cam indexing feed apparatus which allows for the chipping of scrap strip material locally at the strip processing machine.

Another object of the present invention is to provide an adjustable cam indexing feed apparatus which, as a result of its compact size, is readily adaptable to accept a noise enclosure which can easily be built around the apparatus to meet government standards.

Another object of the present invention is to provide an adjustable cam indexing feed apparatus which is readily adjustable to be operative with strip material having various angular blanking patterns, i.e., different blank diameters.

In accordance with one embodiment of the present invention, there is provided first and second cam follower means arranged for reciprocal displacement; connecting means for connecting the first and second cam follower means in spaced-apart relationship whereby the displacement of the first cam follower means causes displacement of the second cam follower means; strip support means for supporting a strip to be indexed, said strip supporting means being coupled to the connecting means for movement in response to the displacement of the first and second cam follower means; cam indexing means eccentrically mounted for rotation about an axis between the first and second cam follower means, the cam indexing means reciprocally displacing the first and second cam follower means upon alternate engagement therewith during rotation of the cam indexing means about the axis; and adjusting means for adjusting the amount of eccentricity of the cam indexing means with respect to the axis to thereby vary the distance of reciprocal displacement of the first and second cam follower means.

In accordance with another embodiment of the present invention, there is provided strip support means for supporting a stirp to be indexed along the first and second axes; forward indexing means for forwardly indexing the strip along the first axis thereof; and lateral indexing means for laterally indexing the strip along the second axis thereof, the lateral indexing means including first and second cam followers arranged for reciprocal displacement, connecting means for connecting the pair of cam followers in fixed spaced-apart relationship whereby the displacement of the first cam follower causes concurrent displacement of the second cam follower, the connecting means being being coupled to the strip support means whereby the strip is laterally indexed in response to the reciprocal displacement of the first and second cam followers, and a cam assembly rotationally arranged between the first and second cam followers for alternate engagement therewith to reciprocally displace the first and second cam followers, the cam assembly including rotating means for rotating the cam assembly about a fixed axis, a cam eccentrically mounted about the rotating means with respect to the fixed axis, and adjusting means for adjusting the amount of eccentricity of the cam with respect to the fixed axis whereby the distance over which the strip is indexed is variable.

BRIEF DESCRIPTION OF THE DRAWINGS

The above description, as well as further objects, features and advantages of the present invention will be more fully understood by reference to the following detailed description of the presently preferred, but nonetheless illustrative, adjustable cam indexing feed apparatus in accordance with the present invention, when taken in conjunction with the accompanying drawings, wherein.

DETAILED DESCRIPTION

Figure 1:
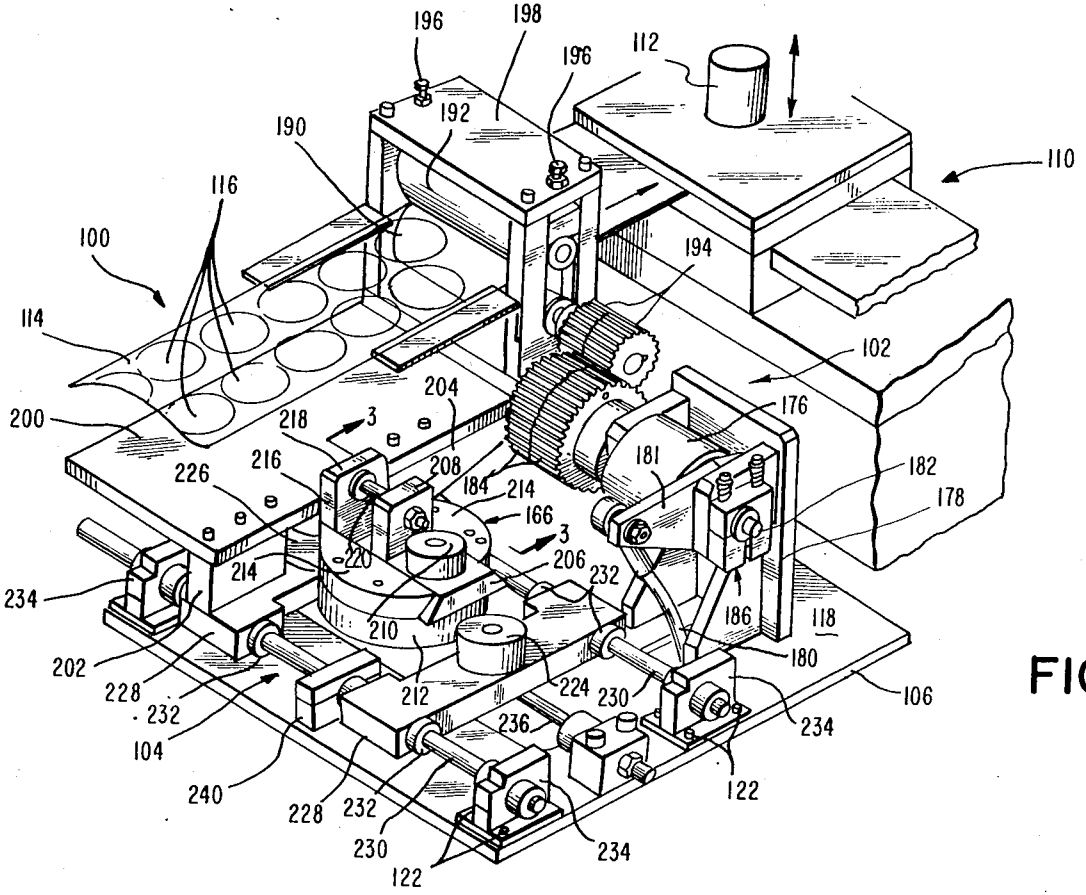
FIG. 1 is a perspective view, as shown from above, of the adjustable cam indexing feed assembly constructed in accordance with the present invention, and which apparatus is shown to integrally include forward and lateral indexing assemblies arranged in operative association with a blanking press.
Figure 2:
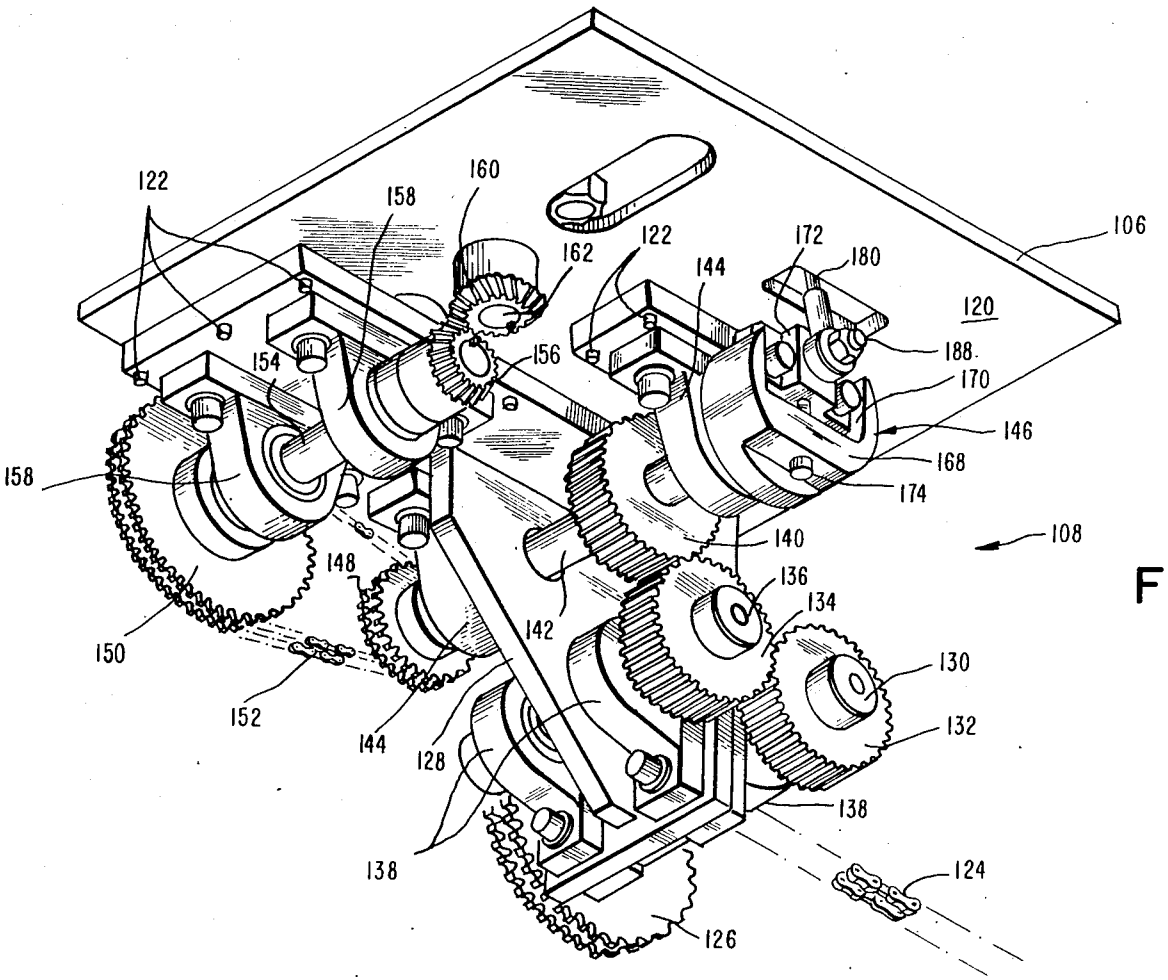
FIG. 2 is a perspective view, as shown from below, showing the drive assemblies for the forward and lateral indexing assemblies as shown in FIG. 1.

Referring now to the drawings, wherein like reference numerals represent like elements, there is disclosed in FIG. 1 a strip-feeder assembly in the nature of an adjustable cam indexing feed apparatus, hereinafter "the apparatus", which is constructed in accordance with the present invention and generally designated by reference numeral 100. The apparatus 100 is generally constructed to include a forward indexing assembly 102 and a lateral indexing assembly 104 mounted overlying a common support plate 106. The forward indexing assembly 102 and lateral indexing assembly 104, as shown in FIG. 2, are operatively driven in synchronized relationship by common direct drive assembly 108 arranged underlying the support plate 106. As shown in FIG. 1, the apparatus 100 is positioned adjacent a strip processing station, for example, a blanking press 110 having a reciprocal acting blanking tool 112 which operates upon a continuous strip 114. The blanking press 110 may be of the single or multiple plunger type.

The apparatus 100 has thus far been described with regard to advancing a continuous strip 114 of metal or plastic material through a blanking press 110. Specifically, the strip 114 is provided with an angular blanking pattern comprising a plurality of blank designations 116 arranged in two adjacent longitudinally extending side-by-side rows. In order to minimize strip waste, the blank designations 116 are arranged having, for example, a thirty degree angle between their centers. This results in an average saving in strip material of about seven percent, the actual saving depending upon the diameter of the blank designations 116 and the bridging required therebetween. The blank designations 116 may be provided in a variety of angular blanking patterns, i.e., other than thirty degrees, as desired, and of shapes other than circular as shown. Although the apparatus 100 has been described with reference to a blanking press 110, it is to be understood that other operations may be performed on the strip 114 being advanced by the apparatus constructed in accordance with the present invention. For example, the strip 114 may be advanced to a strip processing station which applies decals, imprints other indicia, or performs other operations thereon.

Referring now to FIGS. 1 and 2, the forward indexing assembly 102 and lateral indexing assembly 104 are mounted to the top surface 118 of the support plate 106, while the drive assembly 108 is mounted to the bottom surface 120. The various components of the forward and lateral indexing assemblies 102, 104 and drive assembly 108 are secured to the support plate 106 by means of a plurality of bolts 122 extending through openings provided within the support plate. In this manner, the forward and lateral indexing assemblies 102, 104 may be alternatively mounted to the bottom surface 120 of the support plate 106, while the drive assembly 108 may be mounted to the top surface 118. The support plate 106 being so designed, i.e., being rotatable 180° so that the top surface 118 becomes the bottom surface 120, permits the forward and lateral indexing assemblies 102, 104 and drive assembly 108 to be mounted either on the left or right-hand side of the support plate. This feature allows the apparatus 100 to accommodate a blanking press 110 operating left-to-right or right-to-left.

Referring to FIG. 2, the construction and operation of the drive assembly 108 will now be described. The drive assembly 108 is chain driven from a drive sprocket (not shown) fastened to a rotating drive shaft (not shown) provided on the blanking press 110. The direct chain drive between the apparatus 100 and the blanking press 110 provides accurate synchronization of the operation of the forward and lateral indexing assemblies 102, 104 with the operation of the blanking press. This synchronization between the apparatus 100 and the blanking press 110 is achieved by a drive chain 124 which is driven by the blanking press drive sprocket, and which in turn directly drives a drive assembly sprocket 126 mounted onto a drive assembly support bracket 128 mounted to the support plate 106. The sprocket 126 is rotated by the drive chain 124 in the same direction as the rotation of the blanking press drive shaft. Both the blanking press sprocket and the drive assembly sprocket 126 have identical pitch diameters. Therefore, the apparatus 100 will operate on a 1:1 ratio with the blanking press on each operating cycle.

Drive assembly sprocket 126 is mounted to a shaft 130 on which a spur gear 132 is assembled. The spur gear 132 drives an identical spur gear 134 which is assembled to a similar shaft 136. The shafts 130, 136 are journaled to the support bracket 128 by means of pillow block bearings 138. A spur gear 140, which is identical to spur gear 132, 134, is driven from spur gear 134 about a shaft 142 journaled to the support bracket 128 and support plate 106 by means of a pair of pillow block bearings 144. In accordance with this arrangement, spur gear 140 will rotate in the same direction as the blanking press sprocket with a 1:1 ratio. Optionally, where smaller forward and lateral indexing assemblies 102, 104 are employed, shafts 130, 136 can be eliminated along with spur gears 132, 134. In this arrangement, the drive chain 124 will directly engage drive assembly sprocket 126 which will be assembled to shaft 142 at the same location which spur gear 140 is currently positioned.

Figure 3:
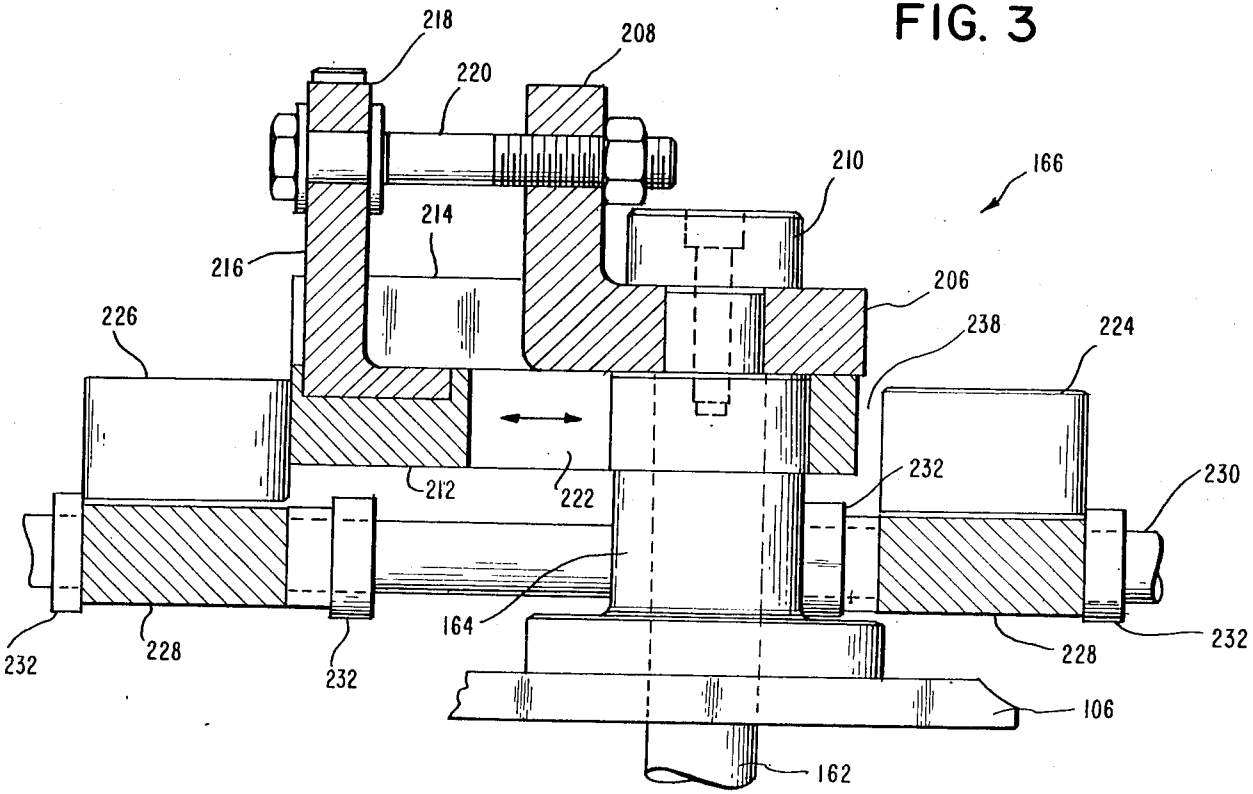
FIG. 3 is a partial cross-section taken along line 3—3 of FIG. 1 showing an adjustable cam mechanism of the present invention comprising an eccentrically mounted cam arranged between a pair of spaced-apart cam followers.

The drive motions for the forward and lateral indexing functions will generate from rotation of shaft 142. That is, shaft 142 will operatively drive the forward indexing assembly 102 through an adjustable crankplate subassembly 146 at one end thereof and the lateral indexing assembly 104 through a sprocket 148 at the other end thereof. Sprocket 148 is connected to a sprocket 150 by a chain 152. Sprocket 150 has a pitch diameter twice the circumference of sprocket 148. As a result, one 360° rotation of sprocket 148 will produce a 180° rotation of sprocket 150. The pitch relationship between sprockets 148, 150 will produce one indexing motion or shift of 180° for one 360° machine cycle or feed stroke. Sprocket 150 is mounted at one end of a shaft 154, while a miter gear 156 is mounted on the other end thereof. Shaft 154 is journaled to the support bracket 128 by means of a pair of pillow block bearings 158. The miter gear 156 is connected to a mating miter gear 160, having the same pitch diameter, and which is mounted on the lower end of a shaft 162. The miter gears 156, 160 transmit the horizontal rotation of shaft 154 to the vertical rotation required for shaft 162. As shown in FIG. 3, shaft 162 is supported by a guide bushing 164 mounted onto the support plate 106. The guide bushing 164, being made from hardened steel, will firmly support shaft 162 from flexing due to eccentric rotational forces applied to the shaft from the lateral indexing assembly 104. Shaft 162 is operative for driving an adjustable indexing cam mechanism 166, hereinafter "the indexing cam mechanism".

Referring to FIGS. 1 and 2, the construction and operation of the forward indexing assembly 102 will now be described. The crankplate subassembly 146 includes a crankplate housing 168 mounted to one end of shaft 142 outwardly adjacent to the pillow block bearing 144. The crankplate housing 168 is provided with an opening 170 which receives an adjustable crankplate connecting member 172 engaged by an adjusting screw 174. The crankplate subassembly 146 drives an indexing clutch 176, which is mounted to a support bracket 178, through a turnbuckle rod 180 connected to crankplate arm 181. One indexing clutch 176 suitable for use with the apparatus 100 of the present invention, is obtainable from Formsprag of Warren, Michi. and designated as Models HPI300-HPI1027. The indexing clutch 176 will, in turn, drive a shaft 182 on which a pair of spur gears 184 are mounted. A friction brake 186 is attached to one end of the shaft 182 adjacent the crankplate arm 181. During the return or resetting cycle of the indexing clutch 176, the friction brake 186 will retain the rotational position of the shaft 182 until the indexing clutch can re-engage with the shaft, rotating it, and accomplishing another feed stroke.

The amount of the feed stroke can be changed by altering the position of a connecting pin 188 which connects the turnbuckle rod 180 to the crankplate connecting member 172. The distance the connecting pin 188 is displaced from the axis of rotation of the crankplate subassembly 146, changes the circular diameter on which the connecting pin rotates. Since the connecting pin 188 is attached to the turnbuckle rod 180, which drives the indexing clutch 176 through crankplate arm 181, the amount of circular motion the connecting pin generates has a direct relationship to the feed stroke. That is, the larger the circular motion, the greater the feed stroke. Similarly, the larger the circular motion, the greater the number of rotational degrees shaft 182 will be rotated by the indexing clutch 176. The position of the connecting pin 188 can be adjusted by turning screw 174 which is located on the outer periphery of the crankplate housing 168.

The pair of spur gears 184 are located on the extreme end of shaft 182 and are operative to drive a pair of strip feed rolls 190, 192 through which an incoming strip 114 is fed. The actual drive connection from the spur gears 184 to the feed rolls 190, 192 may be accomplished through any one of a number of gear ratio arrangements. For example, there may be used a direct 1:1 gear drive connection from spur gears 184 to a pair of spur gears 194 mounted on the feed roll 190. A direct 1:1 gear ratio is particularly suited to small feeds. In the case of medium feed, a 2:1 gear drive connection from spur gears 184 to spur gears 194 is preferred. In the event of large feeds, a 2.7:1 gear drive connection from the spur gears 184, through a gear train (not shown), to spur gears 194 is preferred.

The gear ratio connectiion for driving the feed rolls 190, 192 eliminates the need for large components of the crankplate subassembly 146. In this regard, a small crank circle generated by connecting pin 188 will produce a sufficient stroke to the gear drive connection through the indexing clutch 176 and spur gears 184 to achieve the desired feed pitch. This small crank circle will produce another important benefit, that is, reducing the rotational demand from the indexing clutch 176 for any given feed pitch. At maximum feed the indexing clutch 176 rotates shaft 182 less than 60° per cycle. This arrangement keeps the feed motion both smooth and accurate.

The feed roll 190 functions as a driving roll, while the other feed roll 192 functions as a slave or driven roll. Feed roll 190 is provided with a driving spur gear (not shown) mounted on the opposite side to spur gears 194. Feed roll 192 has, in turn, mounted on one end a similar driven spur gear (not shown) engaged with the driving spur gear. As feed roll 190 is driven by engagement of spur gears 184 with spur gears 194, the drive motion is also transmitted to feed roll 192. Spur gears 194 are arranged to slide back and forth while engaged directly with spur gears 184. This allows the two motions of feeding and indexing of strip 114 to occur simultaneously in the least amount of time. Therefore, the amount of time available for the operation of the blanking press 110 is maximized. Grip pressure, which is required for feeding strip 114 between the feed rolls 190, 192, is applied by two compression springs 196. The compression springs 196 are located above each end of feed roll 192 within a feed roll housing assembly 198. The housing assembly 198 is mounted on a base plate 200 which is connected to the lateral indexing assembly 104 through a pair of connecting members 200, 204 as to be described hereinafter.

Turning now to the central portion of FIG. 1 and FIG. 3 in total, there will be described the construction and operation of the adjustable indexing cam mechanism 166. The indexing cam mechanism has an adjustable cam feature that directly influences the amount of motion required for indexing. The indexing cam mechanism 166 is mounted on the upper end of shaft 162 by an L-shaped dovetail support plate 206 having an upstanding wall 208 and retained on the shaft by an end cap 210. The indexing cam mechanism 166, which is slidingly mounted to the dovetail support plate 206, is constructed of a master cam plate 212, two spaced-apart 60° gib components 214 and an adjusting bracket 216 having an end cap 218. The gib components 214 and adjusting bracket 216 are mounted to the top surface of the master cam plate 212. An adjusting bolt 220 is assembled between the adjusting bracket 216, end cap 218, and threaded through the upstanding wall 208 of the dovetail support plate 206. The adjusting bolt 220, when turned clockwise, will move the indexing cam mechanism 166 toward the dovetail support plate 206 due to the guide bushing 164 being captured within an elongated opening 222 provided within the master cam plate 212. The adjusting bolt 220, when turned counterclockwise, will effect the opposite result as indicated by the double-headed arrow shown within the elongated opening 222. This adjustment of the relative distance between the dovetail support plate 206 and the adjusting bracket 216 will determine the center line position of the indexing cam mechanism 166, which has an overall circular shape, in relationship to the center line of shaft 162. The greater the distance between these two centers, the greater the eccentric path of the indexing cam mechanism 166. In turn, the greater the eccentric path of the cam indexing mechanism 166, the greater the indexing stroke.

As the cam indexing mechanism 166 rotates on its eccentric path, the outer circumference of the master cam plate 212 will alternately engage the outer circumference of a pair of spaced-apart cam followers 224, 226 each constructed in the form of a cylindrical roll. The cam followers 224, 226 are located 180° apart along a common axis which extends through the center line of shaft 162. Each cam follower 224, 226 is mounted on a cross member 228 which is attached to a pair of spaced-apart linear rods 230 overlying the support plate 106. The cross members 228 are secured in fixed spaced-apart relationship to the rods 230 by being arranged between pairs of spaced-apart bushings 232 which are fixedly mounted on the rods. The rods 230 are arranged for reciprocal movement over the support plate 106 as a result of their opposite ends being slidingly received within linear ball bushings 234, which are mounted at opposite ends of the support plate.

As previously described, the housing assembly 198 containing the feed rolls 190, 192 is mounted on base plate 200 which, in turn, is fastened to one of the cross members 228 by means of the connecting members 202, 204. When one of the cam followers 224, 226 is linearly moved by engagement with the master cam plate 212, which is rotating on an eccentric path, all integrated components, i.e., cross members 228, linear rods 230, connecting members 202, 204, base plate 200, housing plate 198 and feed rolls 190, 192, will shift to one side or the other in a linear reciprocating manner to impart the indexing motion to the strip 114. A pair of stops 236, one mounted on each side of the support plate 106, are used to keep the indexing stroke from overshifting by quick indexing movements. These stops 236 also assist the indexing cam mechanism 166 in accurately positioning the feed rolls 190, 192 by providing a positive location by which the indexing motion can register. This arrangement creates a consistently accurate index location.

The center distance between the cam followers 224, 226 has a direct influence on the proper timing sequence required for performing the forward and lateral indexing motions with the strip procesing operations by providing dwell periods. These dwell periods are of predetermined duration by taking into consideration the diameter of the master cam plate 212, the diameter of the cam followers 224, 226 and the amount of lost motion space 238 provided between the outer perimeter of the master cam plate and cam followers. Thus, the duration of the dwell periods are directly proportional to the extent of the space 238 which creates lost motion for the cam followers 224, 226 during a portion of the eccentric rotation of the master cam plate 212. The extent of the space 238 can be changed, and therefore the dwell periods, in a variety of manners, for example, by replacing the cam followers 224, 226 with ones of different diameters, changing the spacing between the cross members 228, and optionally replacing the master cam plate 212 with one of a different diameter. In any event, the extent of the spacing 238 remains constant irrespective of the degree of eccentricity of the cam plate 212. Thus, changing the length of the indexing stroke by means of the indexing cam mechanism 166 will not effect the length of the dwell periods.

During the dwell periods, the position of the cam followers 224, 226 is maintained by a friction brake 240. The friction brake 240 is fastened around one of the linear rods 230 which, as described, is part of the integrated assembly which is ultimately attached to the feed rolls 190, 192. The friction brake 240 is mounted to one side of the support plate 106. Where the apparatus 100 is designed as a small high speed indexing unit, a friction brake 240 engaging each of the linear rods 230 is preferred.

A brief summary of the operation of the apparatus 100 in accordance with the present invention will now be described. The forward indexing assembly 102 and lateral indexing assembly 104 are concurrently operative in synchronization with the operation of the blanking press 110. The drive assembly sprocket (not shown) for the blanking press 110 drives the drive assembly sprocket 126 of the drive assembly 108. In turn, the adjustable crankplate subassembly 146 is driven concurrently with the indexing cam mechanism 166 to effect the forward and lateral indexing of the strip 114 along a zigzag path to the blanking press 110. Driving the adjustable crankplate subassembly 146 is operative to forwardly index the strip 114 by means of the feed rolls 190, 192 being driven by the indexing clutch 176 and the engagement of the spur gears 184, 194. Concurrently, the alternate engagement of the master cam plate 212 with one of the cam followers 224, 226 causes the lateral indexing of the base plate 200 and the housing assembly 198 containing the feed rolls 190, 192. The concurrent forward and lateral indexing is permitted by the sliding engagement of the spur gears 184 with spur gears 194. The resulting operation of the forwarding indexing assembly 102 and lateral indexing assembly 104 causes the strip 114 to be advanced through the blanking press 110 along a zigzag path, such that each blank designation 116 is arranged in registration with the blanking tool 112 at the appropriate dwell period. The extent of the lateral indexing can be readily adjusted by means of adjusting bolt 220 to effect the degree of eccentricity of the master cam plate 212 with regard to the shaft 162. However, the adjusting of the bolt 220 will not alter the dwell periods as the space 238 between the master cam plate 212 and cam followers 224, 226 remains constant.

In accordance with the disclosed invention, there has thus far been described a support arranged adjacent a strip processing station, the processing station having drive means for the operation thereof; strip support means for supporting a strip to be indexed through processing station; forward indexing means arranged on the support for forwardly indexing the strip along its longitudinal axis through the processing station; and lateral indexing means arranged on the support for laterally indexing the strip along a transverse axis through the processing station, the lateral indexing means including first and second cam followers arranged for reciprocal displacement, connecting means for connecting the pair of cam followers in fixed spaced-apart relationship during the reciprocal displacement thereof whereby the displacement of the first cam followers causes concurrent displacement of the second cam follower by an equal distance, the connecting means being attached to a portion of the strip support means whereby the strip is laterally indexed in response to the reciprocal displacement of the first and second cam followers, and a cam assembly rotationally arranged between the first and second cam followers for alternate engagement therewith to reciprocally displace the first and second cam followers, the cam assembly including rotating means for rotating the cam assembly about a fixed axis, a cam having an elongated opening eccentrically mounted with respect to the axis for rotation about the rotating means, a first upstanding bracket secured to the cam, a second upstanding bracket secured to the rotating means and spaced from the first bracket, the cam being movably mounted to the second bracket along an axis of the opening, and control means connecting the first and second brackets for controlling the spaced-apart relationship between the brackets to provide varying amounts of eccentricity of the cam; and coupling means for coupling the drive means to the forward and lateral indexing means for the synchronized operation thereof with respect to the operation of the strip processing station.

Although the invention herein has been described with reference to particular embodiments, it is to be understood that these embodiments are merely illustrative of the principles and application of the present invention. For example, the forward and lateral indexing may be accomplished in successive sequence as opposed to concurrently. It is therefore to be understood that numerous modifications may be made in the illustrative embodiments and that other arrangements may be devised without departing from the spirit and scope of the present invention as defined by the appended claims.

What is claimed is:

1. An apparatus for indexing a strip comprising first and second cam follower means arranged for reciprocal displacement over a predetermined distance; connecting means for connecting said first and second cam follower means in spaced-apart relationship whereby the displacement of said first cam follower means causes displacement of said second cam follower means; strip support means for supporting a strip to be indexed, said strip support means being coupled to said connecting means for movement in response to the displacement of said first and second cam follower means; cam indexing means eccentrically mounted for rotation about an axis between said first and second cam follower means, said cam indexing means reciprocally displacing said first and second cam follower means upon alternate engagement therewith during rotation of said cam indexing means about said axis, said connecting means maintaining the distance between said first and second cam follower means constant during the reciprocal displacement thereof over said predetermined distance, said distance between said first and second cam follower means being greater than the diameter of said cam indexing means whereby the indexing of said strip includes dwell periods whose duration are responsive to the amount said distance between said cam follower means is greater than the diameter of said cam indexing means; and adjusting means for adjusting the amount of eccentricity of said cam indexing means with respect to said axis to thereby vary said predetermined distance of reciprocal displacement of said first and second cam follower means, the duration of said dwell periods being non-responsive to the amount of eccentricity of said cam indexing means with respect to said axis.

2. The apparatus of claim 1 further including rotating means for rotating said cam indexing means about said axis whereby said cam indexing means alternately engages said first and second cam follower means for the indexing of said strip.

3. The apparatus of claim 1 further including strip processing means for processing said strip being indexed.

4. The apparatus of claim 3 further including means coupled to said apparatus for the synchronized operation thereof with respect to the operation of said strip processing means.

5. The apparatus of claim 1, further including forward indexing means for forwardly indexing said strip while said strip is laterally indexed by said cam indexing means.

6. The apparatus of claim 5 wherein said forward indexing means includes a pair of rollers for engaging said strip therebetween and an indexing clutch coupled to said rollers for imparting forward advancing motion to said rollers.

7. The apparatus of claim 6 wherein said indexing clutch is coupled to said rollers by first and second gears arranged movable relative to one another in meshed engagement and having a gear ratio of at least 1:1.

8. The apparatus of claim 5 wherein said forward indexing means indexes said strip along one axis thereof and said cam indexing means indexes said strip along another axis thereof whereby the travel of said strip is along a zigzag path.

9. The apparatus of claim 8 further including means for indexing said strip concurrently along said one and another axes thereof.

10. The apparatus of claim 1 wherein said cam indexing means includes an elongated opening having a longitudinal axis for receiving rotating means for rotating said cam indexing means about said axis, said cam indexing means being movable about said rotating means relative to said axis whereby the amount of said eccentricity is varied in response to said adjusting means.

11. The apparatus of claim 10 wherein said adjusting means includes a first upstanding bracket secured to said cam indexing means and a second upstanding bracket secured to said rotating means and spaced from said first bracket, said cam indexing means being movably mounted to said second bracket along said longitudinal axis of said opening, and control means connecting said first and second brackets for controlling the spaced-apart relationship between said brackets so as to provide varying amounts of eccentricity of said cam indexing means with respect to said axis.

12. The apparatus of claim 11 wherein said cam indexing means is movably mounted to said second bracket by a dovetail arrangement.

13. The apparatus of claim 1 wherein the displacement of said first cam follower means causes equal displacement of said second cam follower means.

14. An apparatus for indexing a strip along first and second axes thereof comprising strip support means for supporting a strip to be indexed along said first and second axes; forward indexing means for forwardly indexing said strip along said first axis thereof; lateral indexing means for laterally indexing said strip along said second axis thereof, said lateral indexing means including first and second cam followers arranged for reciprocal displacement, connecting means for connecting said pair of cam followers in fixed spaced-apart relationship whereby the displacement of said first cam follower causes concurrent displacement of said second cam follower by an equal distance, said connecting means being coupled to said strip support means whereby said strip is laterally indexed in response to the reciprocal displacement of said first and second cam followers; and a cam assembly rotationally arranged between said first and second cam followers for alternate engagement therewith to reciprocally displace said first and second cam followers, said cam assembly including rotating means for rotating said cam assembly about a fixed axis a cam eccentrically mounted about said rotating means with respect to said fixed axis, said connecting means including means for maintaining the distance between said first and second cam followers greater than the distance of said cam, whereby the indexing of said strip is caused to have dwell periods whose duration are responsive to the amount of said distance between said cam followers is greater than the diameter of said cam, and adjusting means for adjusting the amount of eccentricity of said cam with respect to said fixed axis whereby the distance over which said strip is indexed is varable, the duration of said dwell periods being non-responsive to the amount of eccentricity of said cam with respect to said fixed axis.

15. The apparatus of claim 14 further including processing means arranged adjacent said lateral and forward indexing means for processing said strip being indexed, said processing means including drive means coupled to said lateral and forward indexing means for the synchronized operation thereof with respect to the operation of said processing means.

16. The apparatus of claim 15 further including means for concurrently operating said forward and lateral indexing means in response to said drive means.

17. The apparatus of claim 15 further including gear transmission means arranged between said drive means and said forward and lateral indexing means for the synchronized operation thereof.

18. The apparatus of claim 14 further including a support including a top and bottom surface having mounting means arranged thereon for alternatively mounting said forward and lateral indexing means on one of said surfaces, whereby said forward indexing means indexes said strip along respective right and left sides of said support.

19. The apparatus of claim 14 wherein said forward indexing means includes a pair of rollers for engaging said strip therebetween and an indexing clutch coupled to said rollers for imparting forward advancing motion to said rollers.

20. The apparatus of claim 14 wherein said cam includes an elongated opening having a longitudinal axis for receiving said rotating means therein, said cam movable about said rotating means relative to said fixed axis whereby the amount of said eccentricity is varied in response to the operation of said adjusting means.

21. The apparatus of claim 20 wherein said adjusting means includes a first upstanding bracket secured to said cam and a second upstanding bracket secured to said rotating means and spaced from said first bracket, said cam movably mounted to said second bracket along said longitudinal axis of said opening, and control means connecting said first and second brackets for controlling the spaced-apart relationship between said first and second brackets to provide varying amounts of eccentricity of said cam.

22. The apparatus of claim 21 wherein said cam is movably mounted to said second bracket by a dovetail arrangement.

23. The apparatus of claim 14 wherein said forward and lateral indexing means index said strip along a zigzag path.

24. An apparatus for forwardly and laterally indexing a strip through a strip processing station, said apparatus comprising a suport arranged adjacent a strip processing station, said processing station having drive means for the operation thereof; strip support means for supporting a strip to be indexed through said processing station; forward indexing means arranged on said support for forwardly indexing said strip along its longitudinal axis through said processing station; lateral indexing means arranged on said support for laterally indexing said strip along a transverse axis through said processing station, said lateral indexing means including first and second cam followers arranged for reciprocal displacement, connecting means for connecting said pair of cam followers in fixed spaced-apart relationship during the reciprocal displacement thereof whereby the displacement of said first cam follower causes concurrent displacement of said second cam follower by an equal distance, said connecting means being attached to a portion of said strip support means whereby said strip is laterally indexed in response to the reciprocal displacement of said first and second cam followers, and a cam assembly rotationally arranged between said first and second cam followers for alternate engagement therewith to reciprocally displace said first and second cam followers, and cam assembly including rotating means for rotating said cam assembly about a fixed axis, a cam having an elongated opening eccentrically mounted with respect to said axis for rotation about said rotating means, a first upstanding bracket secured to said cam, a second upstanding bracket secured to said rotating means and spaced from said first bracket, said cam being movably mounted to said second bracket along an axis of said opening, and control means connecting said first and second brackets for controlling the spaced-apart relationship between said brackets to provide varying amounts of eccentrically of said cam, said connecting means including means for maintaining the distance between said first and second cam followers greater than the distance of said cam, whereby the indexing of said strip is caused to have dwell periods whose duration are responsive to the amount of said distance between said cam followers is greater than the diameter of said cam, the duration of said dwell periods being non-responsive to the amount of eccentricity of said cam with respect to said fixed axis; and coupling means for coupling said drive means to said forward and lateral indexing means for the synchronized operation thereof with respect to the operation of said strip processing station.

25. The apparatus of claim 24 wherein said strip processing station comprises a strip blanking station including means for blanking said strip being indexed therethrough.

26. The apparatus as set forth in claim 24 wherein said strip is indexed through said processing station along a zigzag path.

27. An apparatus for indexing a strip comprising first and second cam follower means arranged for reciprocal displacement over a predetermined distance; connecting means for connecting said first and second cam follower means in spaced-apart relationship whereby the displacement of said first cam follower means causes displacement of said second cam follower means, strip support means for supporting a strip to be indexed, said strip support means being coupled to said connecting means for movement in response to the displacement of said first and second cam follower means; cam indexing means eccentrically mounted for rotation about an axis between said first and second cam follower means, said cam indexing means reciprocally displacing said first and second cam follower means upon alternate engagement therewith during rotation of said cam indexing means about said axis; said connecting means maintaining the distance between said first and second cam follower means constant during the reciprocal displacement thereof over said predetermined distance, said distance between said first and second cam follower means being greater than the diameter of said cam indexing means whereby the indexing of said strip includes dwell periods whose duration are responsive to the amount said distance between said cam follower means is greater than the diameter of said cam indexing means; rotating means for rotating said cam indexing means about said axis; and adjusting means for adjusting the amount of eccentricity of said cam indexing means with respect to said axis to thereby vary said predetermined distance of reciprocal displacement of said first and second cam follower means, the duration of said dwell periods being non-responsive to the amount of eccentricity of said cam indexing means with respect to said axis, said adjusting means including a first upstanding bracket secured to said cam indexing means and a second upstanding bracket secured to said rotating means and spaced from said bracket, said cam indexing means being movably mounted to said second bracket, and control means connecting said first and second brackets for controlling the spaced-apart relationship between said brackets so as to provide varying amounts of eccentricity of said cam indexing means with respect to said axis.

28. An apparatus for indexing a strip along first and second axes thereof comprising strip support means for supporting a strip to be indexed along said first and second axes; forward indexing means for forwardly indexing said strip along said first axis thereof; lateral indexing means for laterally indexing said strip along said second axis thereof, said lateral indexing means including first and second cam followers arranged for reciprocal displacement, connecting means for connecting said pair of cam followers in fixed spaced-apart relationship whereby the displacement of said first cam follower causes concurrent displacement of said second cam follower by an equal distance, said connecting means being coupled to said strip support means whereby said strip is laterally indexed in response to the reciprocal displacement of said first and second cam followers; and a cam assembly rotationally arranged between said first and second cam followers for alternate engagement therewith to reciprocally displace said first and second cam followers, said cam assembly including rotating means for rotating said cam assembly about a fixed axis, a cam eccentrically mounted about said rotating means with respect to said fixed axis, said cam including an opening having a longitudinal axis for receiving said rotating means therein, said connecting means including means for maintaining the distance between said first and second cam followers greater than the distance of said cam, whereby the indexing of said strip is caused to have dwell periods whose duration are responsive to the amount of said distance between said cam followers is greater than the diameter of said cam, and adjusting means for adjusting the amount of eccentricity of said cam with respect to said fixed axis whereby the distance over which said strip is indexed is variable, the duration of said dwell periods being nonresponsive to the amount of eccentricity of said cam with respect to said fixed axis, said adjusting means including a first upstanding bracket secured to said cam and a second upstanding bracket secured to said rotating means and spaced from said first bracket, said cam movably mounted to said second bracket along said longitudinal axis of said opening, and control means connecting said first and second brackets for controlling the spaced-apart relationship between said first and second brackets to provide varying amounts of eccentricity of said cam.

* * * * *